US011776444B2

(12) United States Patent
Lee et al.

(10) Patent No.: US 11,776,444 B2
(45) **Date of Patent: *Oct. 3, 2023**

(54) PIXEL ARRAY SUBSTRATE

(71) Applicant: Au Optronics Corporation, Hsinchu (TW)

(72) Inventors: Yang-Chun Lee, Hsinchu (TW); Sheng-Yen Cheng, Hsinchu (TW); Yueh-Hung Chung, Hsinchu (TW); Min-Tse Lee, Hsinchu (TW); Kuang-Hsiang Liao, Hsinchu (TW); Shiang-Lin Lian, Hsinchu (TW); Yan-Kai Wang, Hsinchu (TW); Ya-Ling Hsu, Hsinchu (TW); Chen-Hsien Liao, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 102 days.

This patent is subject to a terminal disclaimer.

(21) Appl. No.: 17/521,790

(22) Filed: Nov. 8, 2021

(65) Prior Publication Data

US 2022/0068182 A1 Mar. 3, 2022

Related U.S. Application Data

(63) Continuation of application No. 16/986,272, filed on Aug. 6, 2020, now Pat. No. 11,200,826.
(Continued)

(30) Foreign Application Priority Data

Jun. 18, 2020 (TW) ..... 109120658

(51) Int. Cl.
*G09G 3/20* (2006.01)

(52) U.S. Cl.
CPC ..... *G09G 3/20* (2013.01); *G09G 2310/0202* (2013.01); *G09G 2310/0275* (2013.01)

(58) Field of Classification Search
CPC ..... G09G 2310/0202; G09G 3/20; G09G 2310/0275
See application file for complete search history.

(56) References Cited

U.S. PATENT DOCUMENTS 9,429,780 B2 8/2016 Jo et al.
9,465,268 B2 10/2016 Park et al.
(Continued)

FOREIGN PATENT DOCUMENTS

CN 102403320 4/2012
CN 103869562 6/2014
(Continued)

OTHER PUBLICATIONS

"Office Action of India Counterpart Application", dated Aug. 18, 2022, p. 1-p. 6.

*Primary Examiner* — Gerald Johnson
(74) *Attorney, Agent, or Firm* — JCIPRNET

(57) ABSTRACT

A pixel array substrate, including scanning line pads, data line pads, scanning lines, data lines, gate transmission lines, pixels, a data line signal chip, and a scanning line signal chip, is provided. The scanning lines extend along a first direction. The data lines and the gate transmission lines extend along a second direction. The data lines are electrically connected to the data line pads. The scanning lines are electrically connected to the scanning line pads through the gate transmission lines. A ratio of a number of rows of pixels arranged in the first direction to a number of rows of pixels arranged in the second direction is X:Y. Each pixel includes m sub-pixels.

20 Claims, 11 Drawing Sheets

Related U.S. Application Data

(60) Provisional application No. 62/889,181, filed on Aug. 20, 2019.

(56) References Cited

U.S. PATENT DOCUMENTS

| | | | | |
|---|---|---|---|---|
| 2004/0095541 | A1* | 5/2004 | Takeichi | G02F 1/134336 349/139 |
| 2007/0052902 | A1* | 3/2007 | Yoo | G02F 1/134309 349/139 |
| 2014/0168553 | A1 | 6/2014 | Park et al. | |
| 2017/0061857 | A1 | 3/2017 | Lee et al. | |
| 2017/0097542 | A1* | 4/2017 | Byun | G02F 1/13394 |
| 2020/0278585 | A1* | 9/2020 | Kajita | G06F 3/0446 |
| 2020/0286920 | A1* | 9/2020 | Chen | G02F 1/133514 |

FOREIGN PATENT DOCUMENTS

| | | |
|---|---|---|
| CN | 103869564 | 6/2014 |
| KR | 20150000027 | 1/2015 |

* cited by examiner

PU
RD
D G D D D G D D G D D G

PIXEL ARRAY SUBSTRATE

CROSS-REFERENCE TO RELATED APPLICATION

This application is a continuation application of and claims the priority benefit of U.S. application Ser. No. 16/986,272, filed on Aug. 6, 2020, now allowed, which claims the priority benefit of U.S. provisional application Ser. No. 62/889,181, filed on Aug. 20, 2019 and Taiwan application serial no. 109120658, filed on Jun. 18, 2020. The entirety of each of the above-mentioned patent applications is hereby incorporated by reference herein and made a part of this specification.

BACKGROUND OF THE INVENTION

1. Field of the Invention

The invention relates to a pixel array substrate, and in particular, to a pixel array substrate on which scanning line pads and data line pads are arranged in an arrangement direction.

2. Description of Related Art

Because a display panel has advantages of a small size and low radiation, the display panel is widely applied to various electronic products. In an existing display panel, a drive circuit region with a large area is usually reserved on a periphery of a display region to set a drive circuit, and a sub-pixel is controlled by using the drive circuit. However, the drive circuit region located outside the display region enables the display panel to have an extremely wide frame, and a screen ratio of the product is limited. With the advancement of the science and technology, consumers have increasingly high demands on an appearance of the display panel. In order to increase a purchase intention of the consumers, how to increase the screen ratio of the display panel becomes one of problems to be resolved by manufacturers.

SUMMARY OF THE INVENTION

The invention provides a pixel array substrate to reduce mutual interference of signals between a scanning line pad and a data line pad.

At least one embodiment of the invention provides a pixel array substrate including a plurality of scanning line pads, a plurality of data line pads, a plurality of scanning lines, a plurality of data lines, a plurality of gate transmission lines, a plurality of pixels, a data line signal chip, and a scanning line signal chip. The scanning line pads and the data line pads are located on the substrate. The scanning lines extend along a first direction. The data lines and the gate transmission lines extend along a second direction. The data lines are electrically connected to the data line pads. The scanning lines are electrically connected to the scanning line pads through the gate transmission lines. The pixels are located on the substrate. A ratio of a number of rows of pixels arranged in the first direction to a number of rows of pixels arranged in the second direction is X:Y. Each pixel includes m sub-pixels electrically connected to the scanning lines and the data lines. The data line signal chip is electrically connected to the data line pads, and the scanning line signal chip is electrically connected to the scanning line pads. The scanning line pads and the data line pads are arranged into a plurality of repeated units in an arrangement direction, a sum of a number of scanning line pads and a number of data line pads in each repeated unit is U. $U=a\times(k\times m\times X+h\times n\times Y)$, n being a number of the scanning line signal chip, and a, k, and h being positive integers.

At least one embodiment of the invention provides a pixel array substrate including a plurality of scanning line pads, a plurality of first data line pads, a plurality of second data line pads, a plurality of third data line pads, a plurality of scanning lines, a plurality of data lines, a plurality of gate transmission lines, a plurality of red sub-pixels, a plurality of green sub-pixels, a plurality of blue sub-pixels, and at least one chip on film (COF) circuit. The scanning line pads, the first data line pads, the second data line pads, and the third data line pads are located on the substrate. The scanning line pads, the first data line pads, the second data line pads, and the third data line pads are arranged in an arrangement direction. The scanning lines extend along a first direction. The data lines and the gate transmission lines extend along a second direction. The scanning lines are electrically connected to the scanning line pads through the gate transmission lines. The data lines are electrically connected to the first data line pad, the second data line pad, and the third data line pad. The red sub-pixels, the green sub-pixels, and the blue sub-pixels are electrically connected to the scanning lines and the data lines. The red sub-pixels are electrically connected to the first data line pads. The green sub-pixels are electrically connected to the second data line pads. The blue sub-pixels are electrically connected to the third data line pads. A number of scanning line pads located between the first data line pad and the second data line pad or between the third data line pad and the second data line pad in the arrangement direction is less than a number of scanning line pads located between the first data line pad and the third data line pad. The COF circuit includes a data line signal chip and a scanning line signal chip. The data line signal chip is electrically connected to the first data line pad, the second data line pad, and the third data line pad. The scanning line signal chip is electrically connected to the scanning line pads.

DESCRIPTION OF THE EMBODIMENTS

Figure 1:
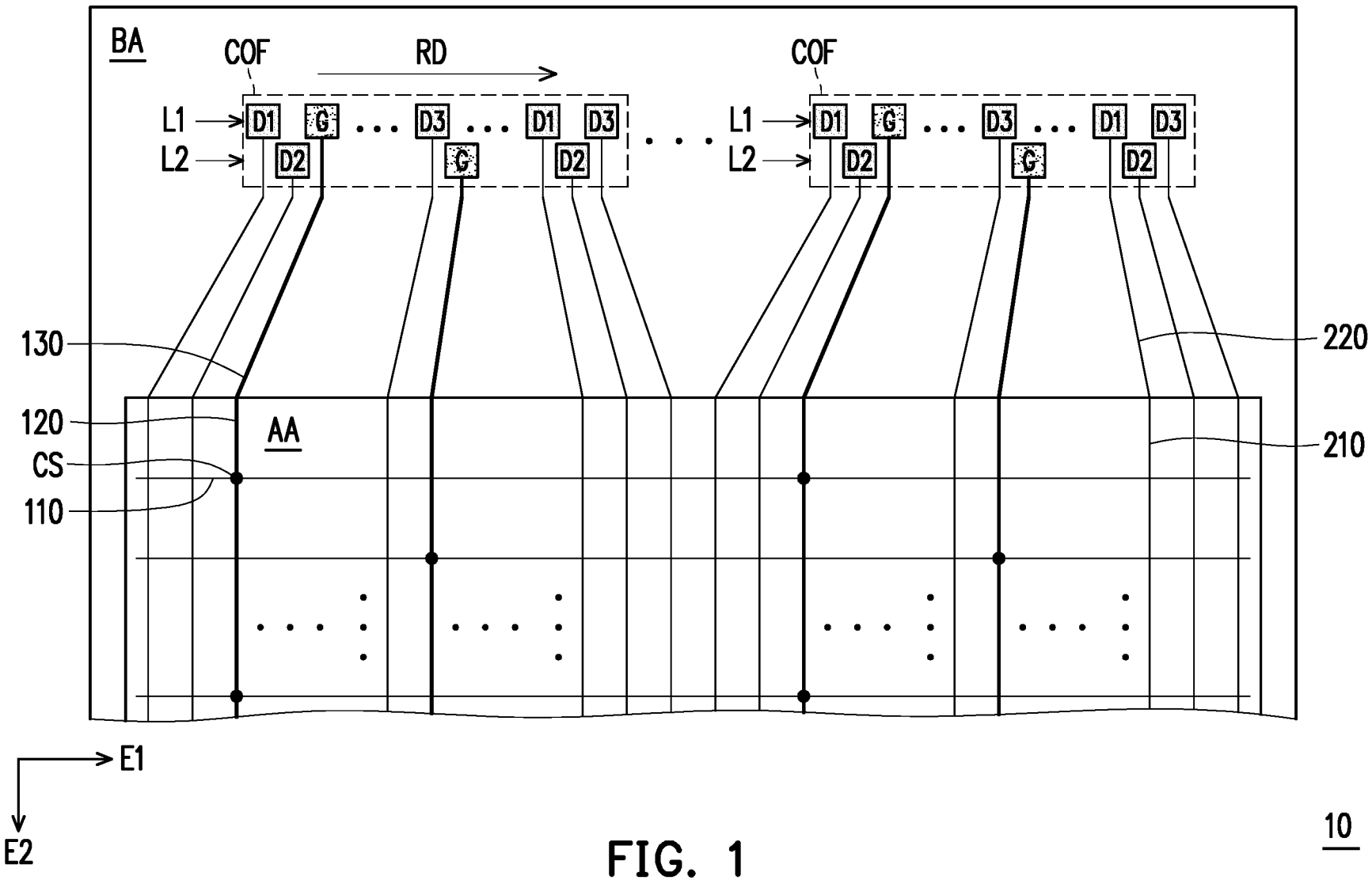
FIG. 1 is a schematic top view of a pixel array substrate according to an embodiment of the invention.

Throughout the specification, same reference numerals indicate same or similar elements. In the accompanying drawings, the thicknesses of layers, films, panels, regions, and the like are enlarged for clarity. It should be understood that when an element such as a layer, film, region or substrate is referred to as being "on" or "connected" to another element, it may be directly on or connected to the another element, or other elements may also be present between the element and the another element. In contrast, when an element is referred to as being "directly on" or "directly connected to" another element, there are no other element present between the element and the another element. As used herein, "connection" may refer to a physical and/or electrical connection. Furthermore, "electrical connection" or "coupling" may mean that there is another element between two elements.

It should be understood that although terms such as "first" and "second" in this specification may be used for describing various elements, components, areas, layers, and/or parts, the elements, components, areas, layers, and/or parts are not limited by such terms. The terms are only used to distinguish one element, component, area, layer, or part from another element, component, area, layer, or part.

Figure 2A:
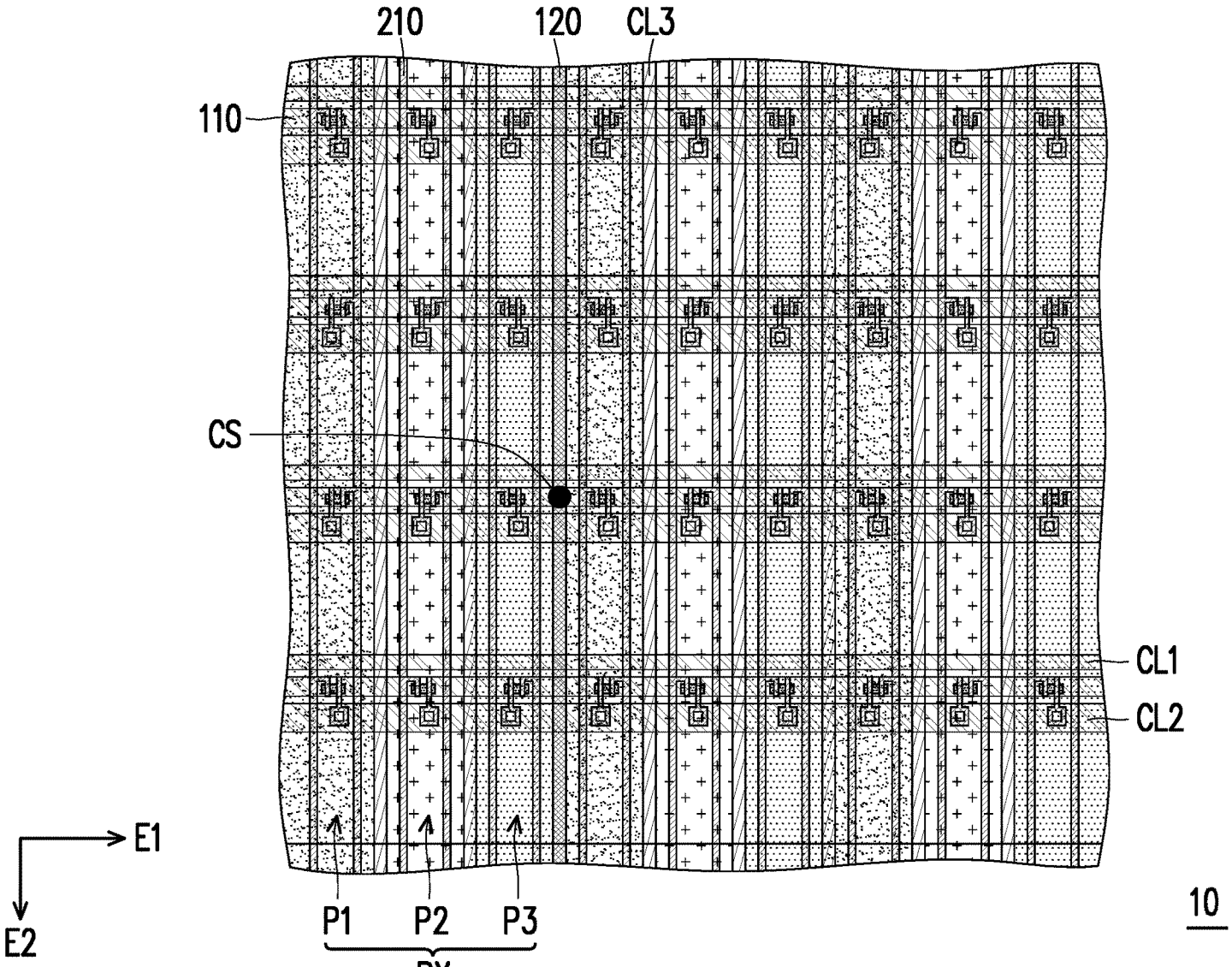
FIG. 2A is a schematic top view of a display region of a pixel array substrate according to an embodiment of the invention.
Figure 2B:
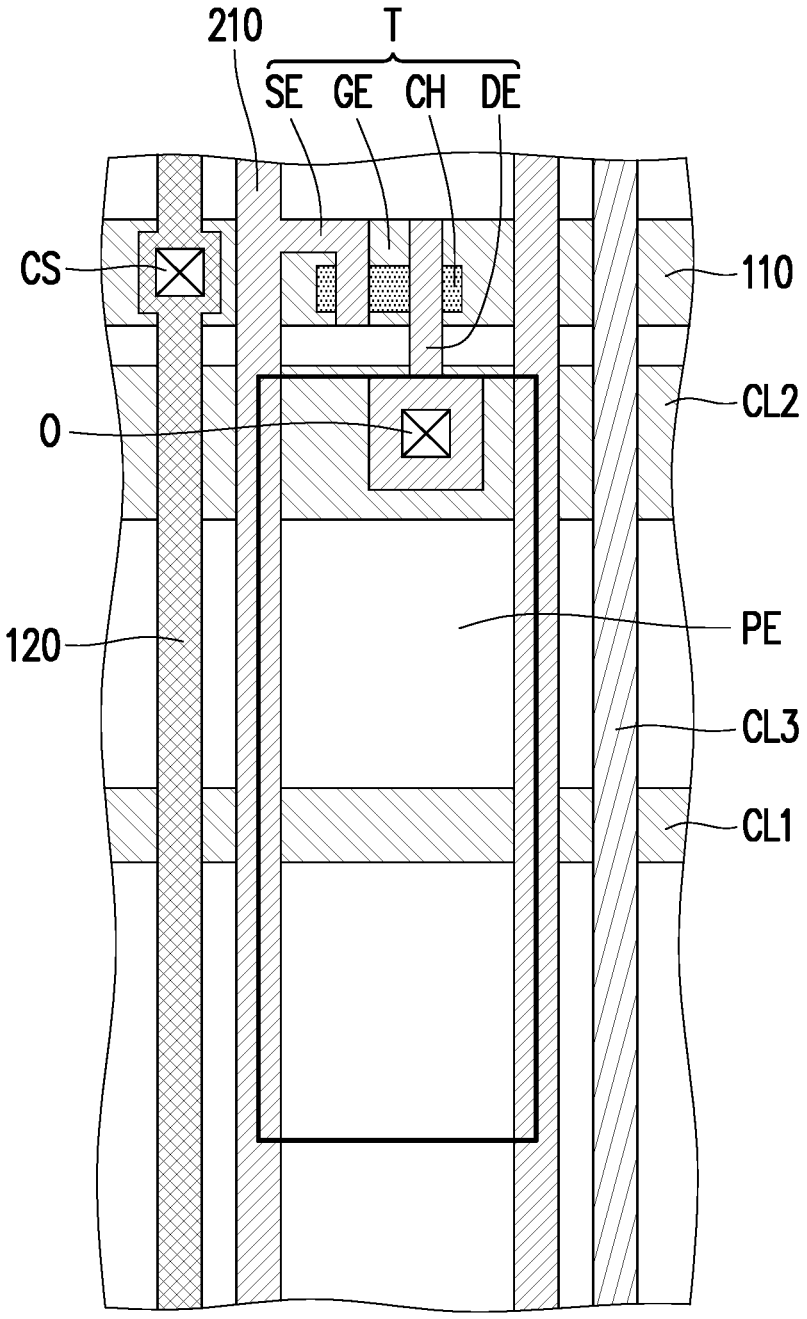
FIG. 2B is a schematic top view of a sub-pixel according to an embodiment of the invention.
Figure 3A:
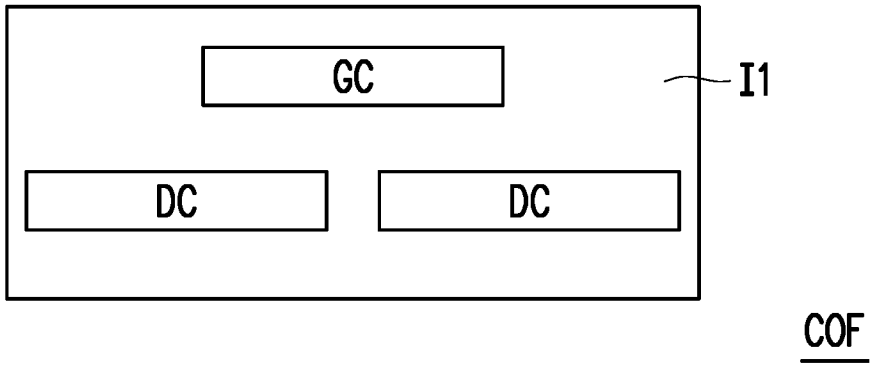
FIG. 3A is a schematic top view of a COF circuit according to an embodiment of the invention.
Figure 3B:
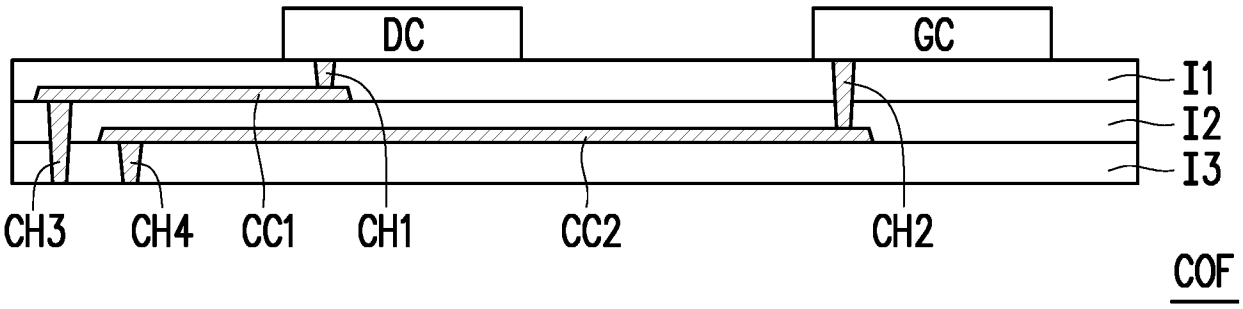
FIG. 3B is a schematic top view of a COF circuit according to an embodiment of the invention.

FIG. 1 is a schematic top view of a pixel array substrate according to an embodiment of the invention. FIG. 2A is a schematic top view of a display region of a pixel array substrate according to an embodiment of the invention. FIG. 2B is a schematic top view of a sub-pixel of FIG. 2A. FIG. 3A is a schematic top view of a COF circuit according to an embodiment of the invention. FIG. 3A is, for example, a schematic enlarged diagram of a COF circuit of FIG. 1. FIG. 3B is a schematic top view of a COF circuit according to an embodiment of the invention.

Referring to FIG. 1, a pixel array substrate 10 includes a plurality of scanning line pads G, a plurality of data line pads (such as a first data line pad D1, a second data line pad D2, and a third data line pad D3), and a plurality of scanning lines 110, a plurality of data lines 210, a plurality of gate transmission lines 120, a plurality of pixels (not shown in FIG. 1) and at least one COF circuit. In the present embodiment, the pixel array substrate 10 further includes a plurality of first fan-out lines 130 and a plurality of second fan-out lines 220.

A substrate SB has a display region AA and a peripheral region BA outside the display region AA. The substrate SB may be made of glass, quartz, an organic polymer, or an opaque/a reflective material (for example, a conductive material, metal, wafer, ceramic or other applicable materials) or other applicable materials. If a conductive material or metal is used, an insulating layer (not shown) is covered on a carrier SB to prevent short circuit.

The scanning line pads G are located on the substrate SB. In the present embodiment, the scanning line pads G are located on the peripheral region BA. The first fan-out lines 130 electrically connect the scanning line pads G to the gate transmission lines 120. The scanning lines 110 and the gate transmission lines 120 are located in the display region AA. The scanning lines 110 extend along a first direction E1, and the gate transmission lines 120 extend along a second direction E2. In the present embodiment, the gate transmission lines 120 are electrically connected to the scanning lines 110 through a switch structure CS, and the scanning lines 110 are electrically connected to the scanning line pads G through the gate transmission lines 120 and the first fan-out lines 130.

In the present embodiment, the scanning line pads G are electrically connected to two corresponding scanning lines 110, thereby reducing a number of the scanning line pads G, but the invention is not limited thereto. In other embodiments, different scanning lines 110 do not share a same scanning line pad G.

The data line pads (such as the first data line pad D1, the second data line pad D2, and the third data line pad D3) are located on the substrate SB. In the present embodiment, the data line pads are located on the peripheral region BA. Second fan-out lines 220 electrically connect the data line pads to the data lines 210. The data lines 210 extend along a second direction E2.

Referring to FIG. 1 and FIG. 2A, pixels PX are located on the substrate SB. In the present embodiment, each pixel 300 includes a red sub-pixel P1, a green sub-pixel P2, and a blue sub-pixel P3, but the invention is not limited thereto. In other embodiments, each pixel PX further includes sub-pixels of other colors.

Referring to FIG. 1, FIG. 2B, and FIG. 2A, in the present embodiment, the pixel array substrate 10 is driven in a manner of half-gate two-data line (HG2D), and the sub-pixels (the red sub-pixel P1, the green sub-pixel P2, and the blue sub-pixel P3) overlap corresponding two of the data lines 210 and a corresponding one of the scanning lines 110.

The sub-pixels are electrically connected to the scanning lines 110 and the data lines 210. In the present embodiment, the red sub-pixel P1, the green sub-pixel P2, and the blue sub-pixel P3 are electrically connected to the scanning lines 110 and the data lines 210. The red sub-pixel P1 is electrically connected to a first data line pad D1. The green sub-pixel P2 is electrically connected to a second data line pad D2. The blue sub-pixel P3 is electrically connected to the third data line pad D3.

Each sub-pixel includes a switching element T and a pixel electrode PE. The switching element T includes a gate GE, a channel layer CH, a source SE, and a drain DE.

The gate GE is located on the substrate SB and is electrically connected to a corresponding scanning line 110. The channel layer CH overlaps the gate GE, a gate insulating layer (not shown in the figure) being sandwiched between the channel layer CH and the gate GE.

The source SE and the drain DE are electrically connected to the channel layer CH. The source SE is electrically connected to the data line 210. The flat layer (not shown in the figure) is located on the source SE and the drain DE. The pixel electrode PE is located on the flat layer and is electrically connected to the drain DE through an opening O penetrating through the flat layer.

In some embodiments, the pixel array substrate 10 further includes a common signal line CL1, a common signal line CL2, and a common signal line CL3. The common signal line CL1, the common signal line CL2, and the scanning line 110 extend along a first direction E1, and the common signal line CL1, the common signal line CL2, and the scanning line 110 belong to a same conductor layer (for example, a first metal layer). The common signal line CL3, the data line 210, and the gate transmission line 120 extend along a second direction E2, and the common signal line CL3, the data line 210, and the gate transmission line 120 belong to a same conductor layer (for example, a second metal layer).

The scanning line pads G and the data line pads (for example, the first data line pad D1, the second data line pad D2, and the third data line pad D3) are arranged in an arrangement direction RD. In the present embodiment, the scanning line pads G and the data line pads are arranged in a first row L1 and a second row L2 in the arrangement direction RD. Pads in a first row L1 are aligned with each other, and pads in a second row L2 are aligned with each other. The scanning line pads G and the data line pads are arranged in two rows in the arrangement direction RD, so that a wiring space may be used more effectively. In some embodiments, pads in a first row L1 and pads in a second row L2 belong to different metal layers. For example, the pads in the first row L1 belong to a first metal layer, and pads in the second row L2 belong to a second metal layer. There is an insulating layer between the first metal layer and the second metal layer, thereby preventing short circuit between adjacent pads.

In some embodiments, a number of the scanning line pads G located between the first data line pad D1 and the second data line pad D2 or between the third data line pad D3 and the second data line pad D2 in the arrangement direction RD is less than a number of scanning line pads G located between the first data line pad D1 and the third data line pad D3, thereby reducing an influence of signal interference between the scanning line pad G and the data line pad on a displayed image.

A COF circuit is electrically connected to the scanning line pads G and the data line pads D (for example, the first data line pad D1, the second data line pad D2, and the third data line pad D3).

Referring to FIG. 3A and FIG. 3B, a COF circuit includes a data line signal chip DC, a scanning line signal chip GC, a first insulating layer I1, a second insulating layer I2, a third insulating layer I3, a first conductor layer CC1, a second conductor layer CC2, a plurality of first connection structure CH1, a plurality of second connection structures CH2, a plurality of third connection structures CH3, and a plurality of fourth connection structures CH4.

The first insulating layer I1, the second insulating layer I2, and the third insulating layer I3 sequentially overlap. The data line signal chip DC and the scanning line signal chip GC are located on the first insulating layer I1.

The first conductor layer CC1 is located between the second insulating layer I2 and the first insulating layer I1. The plurality of first connection structures CH1 penetrate through the first insulating layer I1 and are electrically connected to the first conductor layer CC1.

The second conductor layer CC2 is located between the second insulating layer I2 and the third insulating layer I3. A plurality of second connection structures CH2 penetrates through the first insulating layer I1 and the second insulating layer I2, and are electrically connected to the second conductor layer CC2. In the present embodiment, because the first conductor layer CC1 and the second conductor layer CC2 belong to different film layers, respectively, a wiring space of the first conductor layer CC1 and the second conductor layer CC2 may be effectively increased.

The third connection structure CH3 penetrates through the second insulating layer I2 and the third insulating layer I3, and is electrically connected to the first conductor layer CC1. A plurality of fourth connection structures CH4 penetrates through the third insulating layer I3 and is electrically connected to the second conductor layer CC2.

The data line signal chip DC is electrically connected to one of the first conductor layer CC1 and the second conductor layer CC2, and the scanning line signal chip GC is electrically connected to the other of the first conductor layer CC1 and the second conductor layer CC2. In the present embodiment, the data line signal chip DC is electrically connected to the first conductor layer CC1, and the scanning line signal chip GC is electrically connected to the second conductor layer CC2.

The data line signal chip DC is electrically connected to the data line pads (such as the first data line pad D1, the second data line pad D2, and the third data line pad D3 in FIG. 1), and the scanning line signal chip GC is electrically connected to the scanning line pads G.

In the present embodiment, the data line signal chip DC and the scanning line signal chip GC are located on a same side of a display region AA, and therefore a frame of a display panel may be reduced, thereby increasing a screen ratio of a display device. In some embodiments, a width between a side edge of the display region AA where a COF circuit is not provided and a side edge of a pixel array substrate 10 is less than 2 mm.

In the present embodiment, a COF circuit includes a data line signal chip DC and a scanning line signal chip GC. Therefore, a first fan-out line 130 and a second fan-out line 220 may not overlap each other, thereby improving an influence of signal interference between the first fan-out line 130 and the second fan-out line 220 on the display image.

Referring to FIG. 1, in the present embodiment, the pixel array substrate 10 includes n scanning line signal chips GC. For example, the pixel array substrate 10 includes two COF circuits. Each COF circuit includes one scanning line signal chip GC. Therefore, the pixel array substrate 10 includes two scanning line signal chips in total GC, that is, n is 2. In other embodiments, n is greater than 2.

In the present embodiment, each scanning line 110 is electrically connected to a plurality of scanning line signal chips GC, so that signals on the scanning line 110 may be more evenly distributed. For example, the pixel array substrate 10 includes n scanning line signal chips GC in total. Each scanning line 110 is electrically connected to n scanning line signal chips GC.

Figure 4:
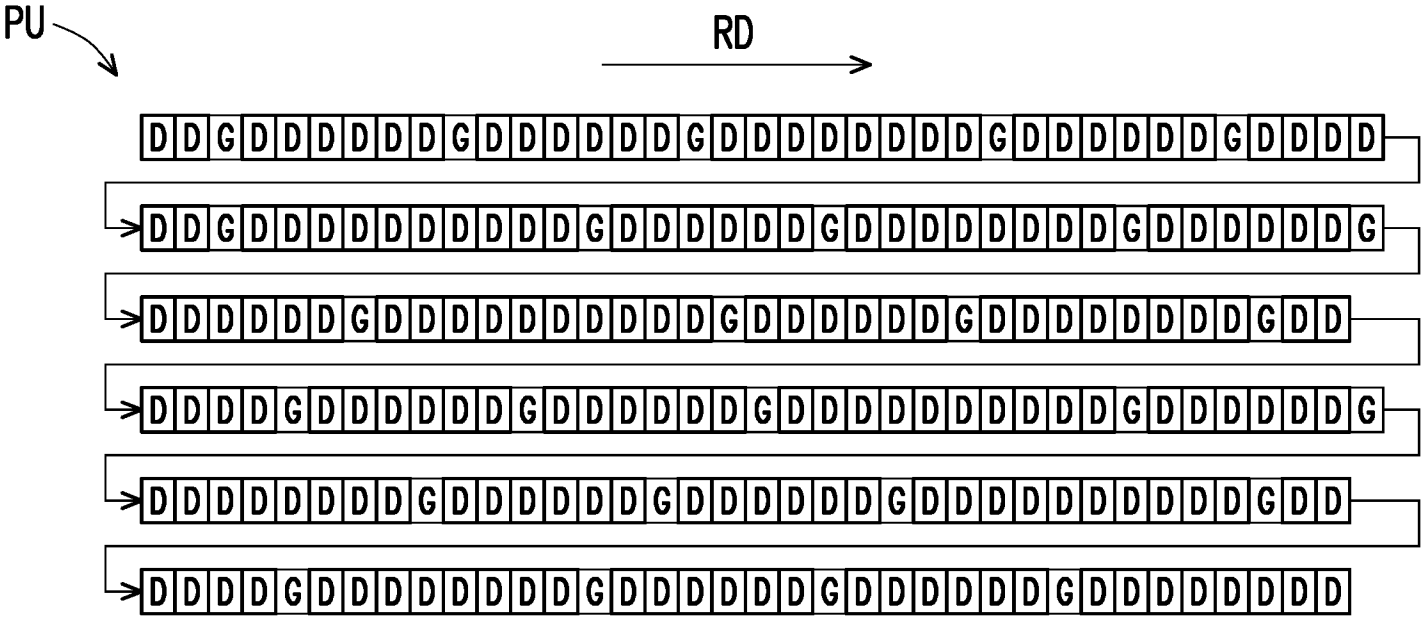
FIG. 4 is a schematic diagram of an arrangement sequence of scanning line pads and data line pads according to Embodiment 1 of the invention.

FIG. 4 is a schematic diagram of an arrangement sequence of scanning line pads and data line pads according to Embodiment 1 of the invention.

The scanning line pads G and the data line pads D (for example, the first data line pad, the second data line pad, and the third data line pad) are arranged into a plurality of repeated units PU in an arrangement direction RD. A sum of a number of the scanning line pads G and a number of data line pads D in each repeated unit PU is U.

FIG. 4 illustrates an arrangement order of the scanning line pads G and the data line pads D in a repeated unit PU, the scanning line pads G and the data line pads D in the repeated unit PU being not completely aligned with each other. For example, the scanning line pads G and the data line pads D in the repeated unit PU may be divided into a first row L1 and a second row L2 as shown in FIG. 1. A first pad in a first row L1 in FIG. 1 is a first pad in FIG. 4, a first pad in a second row L2 in FIG. 1 is a second pad in FIG. 4, a second pad in a first row L1 in FIG. 1 is a third pad in FIG. 4, and other pads are also arranged in this order.

In the present embodiment, as shown in FIG. 2, a ratio of a number of rows of pixels PX arranged in a first direction E1 to a number of rows of pixels PX arranged in a second direction E2 is X:Y. For example, in a display panel with a resolution of 1920×1080, X:Y is 16:9. In the present embodiment, each pixel PX includes m sub-pixels, m being a positive integer. In the present embodiment, in order to improve signal interference between the scanning line pads G and the data line pads D, the scanning line pads G and the data line pads D conform to a rule of Formula 1.

$$U=a\times(k\times m\times X+h\times n\times Y) \quad \text{Formula 1:}$$

In Formula 1, n is a number of scanning line signal chips, and a, k, and h are positive integers.

Embodiment 1

In Embodiment 1, a pixel array substrate is driven in a manner of HG2D, and each sub-pixel overlaps two data lines and one scanning line. In Embodiment 1, each scanning line pad G is electrically connected to two corresponding scanning lines. In Embodiment 1, one part of the scanning line pads G are located in the first row L1, and the other part of the scanning line pads G are located in a second row L2 (as shown in FIG. 1). One part of the scanning line pads G belong to a first metal layer, and the other part of the scanning line pads G belong to a second metal layer. In Embodiment 1, a is 1, k is 4, and his 1.

X:Y is 16:9. Each pixel PX includes 3 sub-pixels, that is, m is 3. The pixel array substrate has 3 scanning line signal chips, that is, n is 3.

In Embodiment 1, a sum of a number of the scanning line pads G and a number of the data line pads D in each repeated unit PU is calculated by Equation 1, U=1×(4×3×16+1×3×9)=219, which means that the sum of the number of the scanning line pads G and the number of the data line pads D in each repeated unit PU is 219.

In Embodiment 1, in order to cause the scanning line pads G and the data line pads D to be more evenly dispersed, a number R of data line pads D between two adjacent scanning line pads G in an arrangement direction RD meets a rule of Equation 2.

$$R=2\times m\times N \quad \text{Formula 2:}$$

In Equation 2, N is an integer between 1 and k+1.

In Embodiment 1, R=2×3×1 to 2×3×5, which means that the number of data line pads D between two adjacent scanning line pads G is between 6 and 30.

Figure 5:
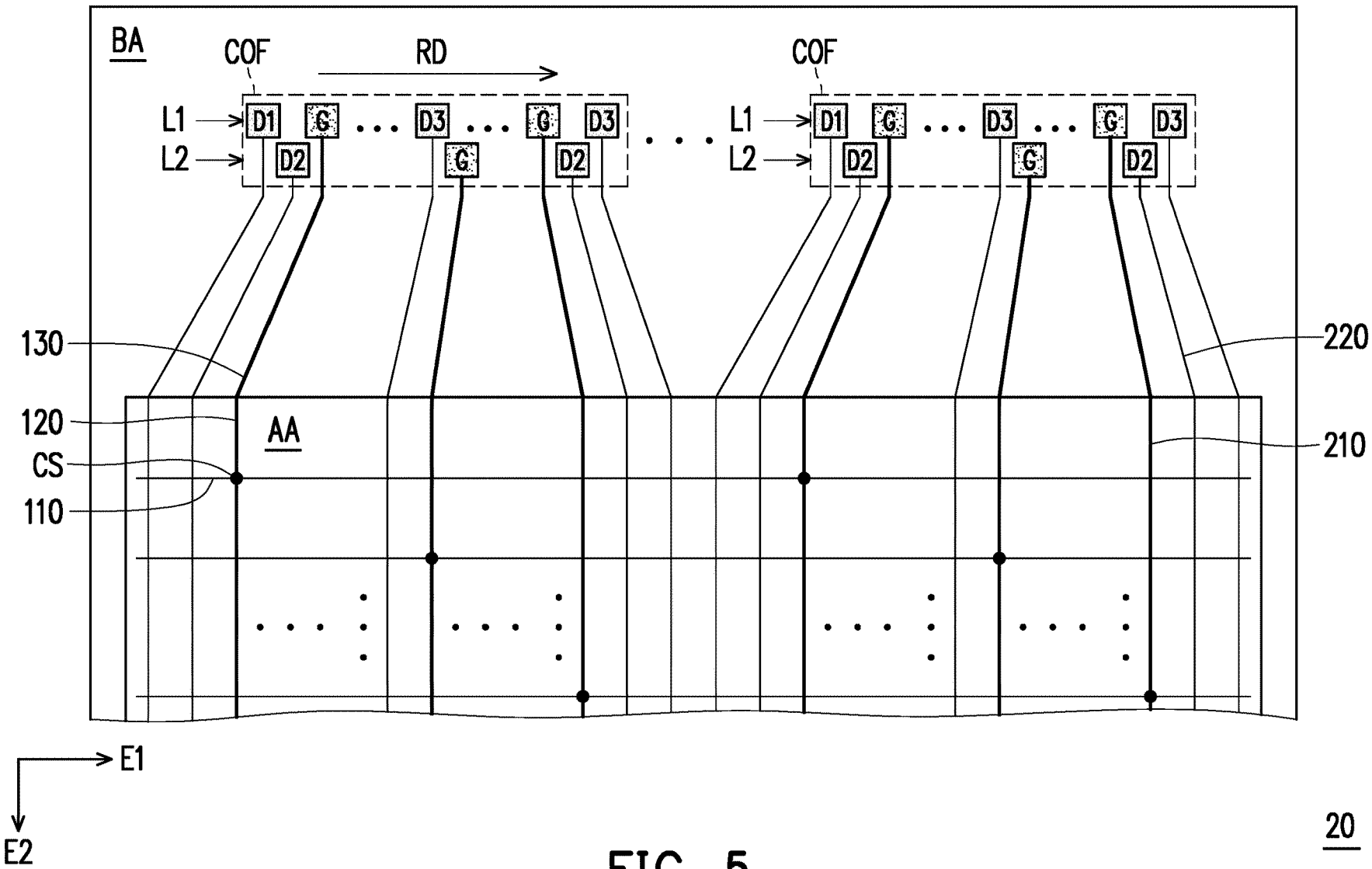
FIG. 5 is a schematic top view of a pixel array substrate according to an embodiment of the invention.

FIG. 5 is a schematic top view of a pixel array substrate according to an embodiment of the invention. It must be noted herein that an embodiment of FIG. 5 uses element numbers and some content of the embodiment of FIG. 1, a same or similar reference numeral being used to represent a same or similar element, and description of same technical content is omitted. For the description of the omitted parts, reference may be made to the foregoing embodiments, and the descriptions thereof are omitted herein.

A difference between a pixel array substrate 20 of FIG. 5 and the pixel array substrate 10 of FIG. 1 is that: in the pixel array substrate 20, different scanning lines 110 do not share a same scanning line pad G.

Referring to FIG. 5, in the present embodiment, each gate transmission line 120 electrically connects a corresponding scanning line pad G to a corresponding scanning line 110.

Figure 6:
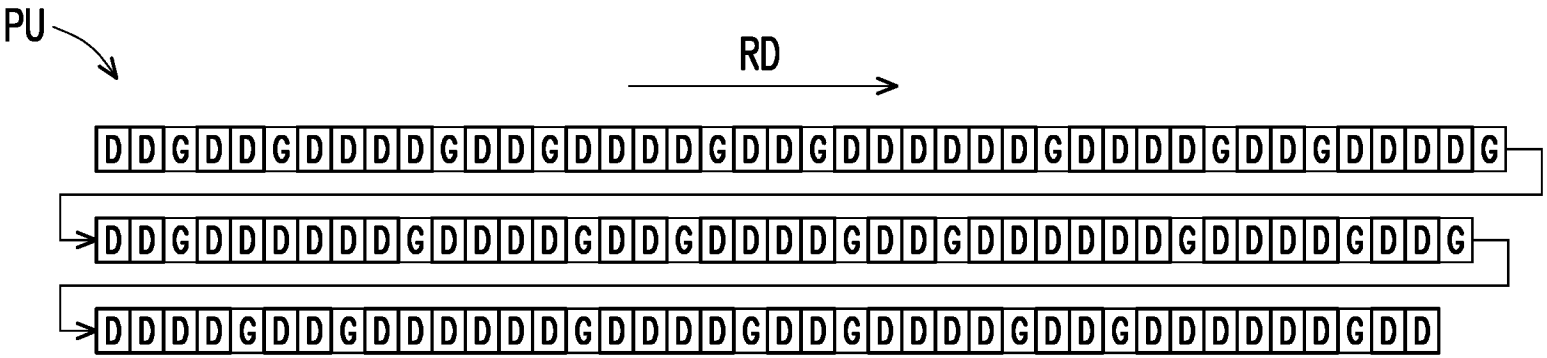
FIG. 6 is a schematic diagram of an arrangement sequence of scanning line pads and data line pads according to Embodiment 2 of the invention.

FIG. 6 is a schematic diagram of an arrangement sequence of scanning line pads and data line pads according to Embodiment 2 of the invention.

The scanning line pads G and the data line pads D (for example, the first data line pad, the second data line pad, and the third data line pad) are arranged into a plurality of repeated units PU in an arrangement direction RD. A sum of a number of the scanning line pads G and a number of data line pads D in each repeated unit PU is U.

FIG. 6 illustrates an arrangement order of the scanning line pads G and the data line pads D in a repeated unit PU, the scanning line pads G and the data line pads D in the repeated unit PU being not completely aligned with each other. For example, the scanning line pads G and the data line pads D in the repeated unit PU may be divided into a first row L1 and a second row L2 as shown in FIG. 5. A first pad in a first row L1 in FIG. 5 is a first pad in FIG. 6, a first pad in a second row L2 in FIG. 5 is a second pad in FIG. 6, a second pad in a first row L1 in FIG. 5 is a third pad in FIG. 6, and other pads are also arranged in this order.

In the present embodiment, as shown in FIG. 2, a ratio of a number of rows of pixels PX arranged in a first direction E1 to a number of rows of pixels PX arranged in a second direction E2 is X:Y. In the present embodiment, each pixel PX includes m sub-pixels, m being a positive integer. In the present embodiment, in order to improve signal interference between the scanning line pads G and the data line pads D, the scanning line pads G and the data line pads D conform to a rule of Formula 1.

Embodiment 2

In Embodiment 2, a pixel array substrate is driven in a manner of HG2D, and each sub-pixel overlaps two data lines and one scanning line. In Embodiment 2, each scanning line pad G is electrically connected to a corresponding scanning line, and different scanning lines are not electrically connected through a scanning line pad or a gate transmission line directly. In Embodiment 2, one part of the scanning line pads G are located in a first row L1, and the other part of the scanning line pads G are located in a second row L2 (as shown in FIG. 5). One part of the scanning line pads G belong to a first metal layer, and the other part of the scanning line pads G belong to a second metal layer. In Embodiment 2, a is 1, k is 2, and h is 1.

X:Y is 16:9. Each pixel PX includes 3 sub-pixels, that is, m is 3. The pixel array substrate has 3 scanning line signal chips, that is, n is 3.

In Embodiment 2, a sum of a number of scanning line pads G and a number of data line pads D in each repeated unit PU is calculated by Equation 1, U=1×(2×3×16+1×3×9)=123, which means that the sum of the number of scanning line pads G and the number of data line pads D in each repeated unit PU is 123.

In Embodiment 2, in order to cause the scanning line pads G and the data line pads D to be more evenly dispersed, a number R of data line pads D between two adjacent scanning line pads G in an arrangement direction RD meets a rule of Equation 2.

In Embodiment 2, R=2×3×1 to 2×3×3, which means that a number of data line pads D between two adjacent scanning line pads G is between 6 and 18.

Figure 7:
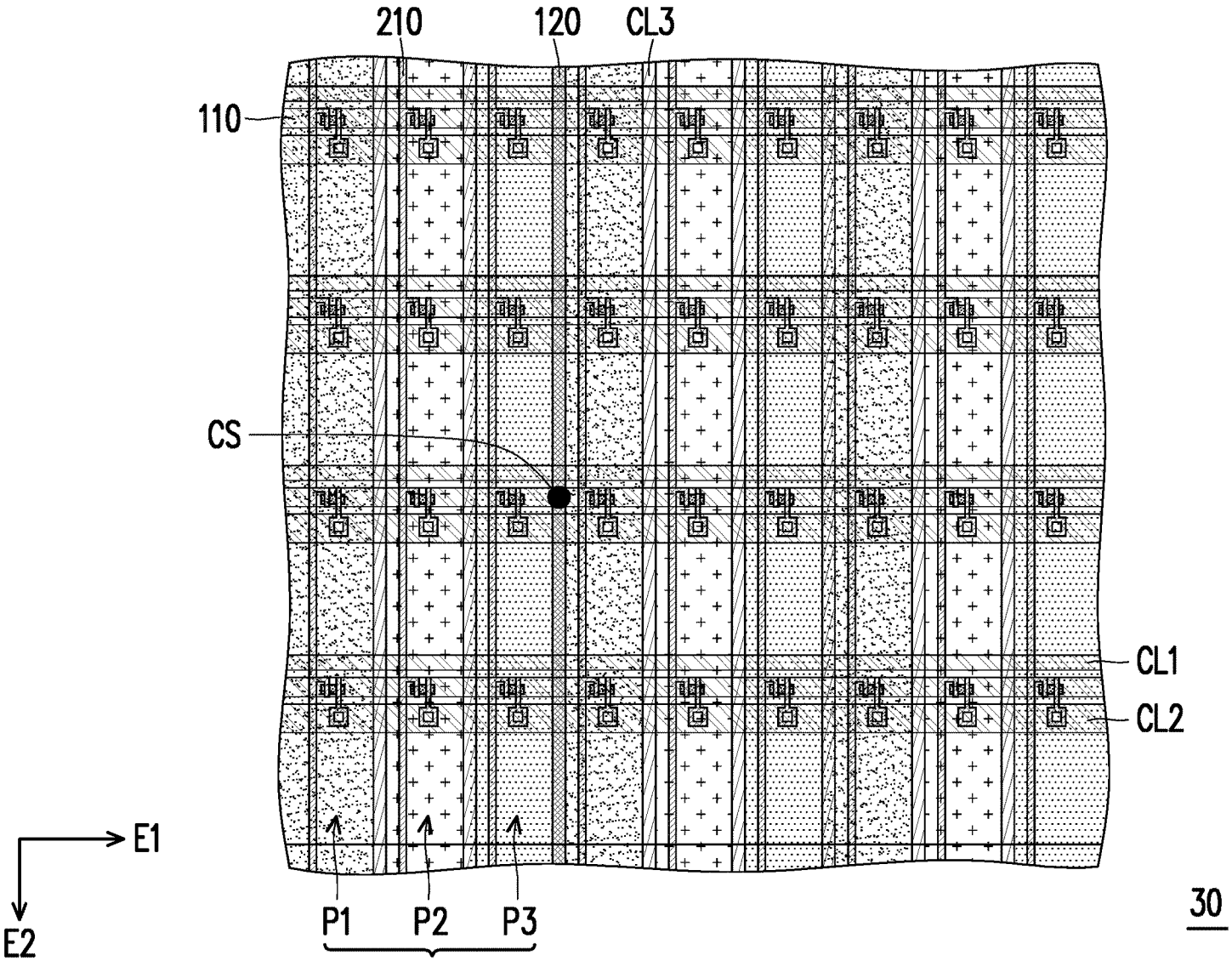
FIG. 7 is a schematic top view of a pixel array substrate according to an embodiment of the invention.

FIG. 7 is a schematic top view of a pixel array substrate according to an embodiment of the invention. It must be noted herein that an embodiment of FIG. 7 uses the element numbers and some content of the embodiment of FIG. 2A, a same or similar reference numeral being used to represent a same or similar element, and description of same technical content is omitted. For the description of the omitted parts, reference may be made to the foregoing embodiments, and the descriptions thereof are omitted herein.

A difference between a pixel array substrate 30 of FIG. 7 and the pixel array substrate 10 of FIG. 2A is that: the pixel array substrate 30 is driven in a manner of one-gate one-data line (1G1D), and each of the sub-pixels (a red sub-pixel P1, a green sub-pixel P2, and a blue sub-pixel P3) overlaps a corresponding one of data lines 210 and a corresponding one of scanning lines 110.

Figure 8:
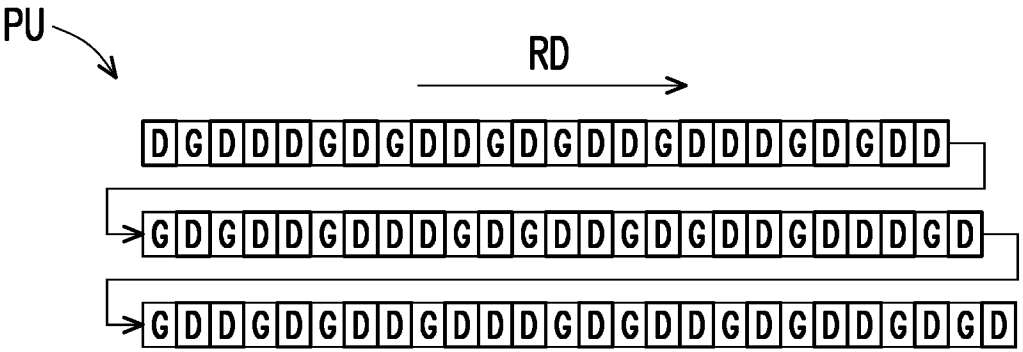
FIG. 8 is a schematic diagram of an arrangement sequence of scanning line pads and data line pads according to Embodiment 3 of the invention.

FIG. 8 is a schematic diagram of an arrangement sequence of scanning line pads and data line pads according to Embodiment 3 of the invention.

The scanning line pads G and the data line pads D (for example, the first data line pad, the second data line pad, and the third data line pad) are arranged into a plurality of repeated units PU in an arrangement direction RD. A sum of a number of the scanning line pads G and a number of data line pads D in each repeated unit PU is U.

FIG. 8 illustrates an arrangement order of the scanning line pads G and the data line pads D in a repeated unit PU, the scanning line pads G and the data line pads D in the repeated unit PU being not completely aligned with each other. For example, the scanning line pads G and the data line pads D in the repeated unit PU may be divided into a first row L1 and a second row L2 as shown in FIG. 5. A first pad in a first row L1 in FIG. 1 is a first pad in FIG. 8, and a first pad in the second row L2 in FIG. 5 is a second pad in FIG. 8, and a second pad in a first row L1 in FIG. 5 is a third pad in FIG. 8, and the other pads are arranged in this order.

In the present embodiment, as shown in FIG. 7, a ratio of a number of rows of pixels PX arranged in a first direction E1 to a number of rows of pixels PX arranged in a second direction E2 is X:Y. In the present embodiment, each pixel PX includes m sub-pixels, m being a positive integer. In the present embodiment, in order to improve signal interference between the scanning line pads G and the data line pads D, the scanning line pads G and the data line pads D conform to a rule of Formula 1.

Embodiment 3

In Embodiment 3, a pixel array substrate is driven in a manner of 1G1D, and each sub-pixel overlaps one data line and one scanning line. In Embodiment 3, each scanning line pad G is electrically connected to a corresponding scanning line, and different scanning lines are not electrically connected through a scanning line pad or a gate transmission line directly. In Embodiment 3, one part of the scanning line pads G are located in a first row L1, and the other part of the scanning line pads G are located in a second row L2 (as shown in FIG. 5). One part of the scanning line pads G belong to a first metal layer, and the other part of the scanning line pads G belong to a second metal layer. In Embodiment 3, a is 1, k is 1, and h is 1.

X:Y is 16:9. Each pixel PX includes 3 sub-pixels, that is, m is 3. The pixel array substrate has 3 scanning line signal chips, that is, n is 3.

In Embodiment 3, a sum of a number of scanning line pads G and a number of data line pads D in each repeated unit PU is calculated by Equation 1, $U=1\times(1\times3\times16+1\times3\times9)=75$, which means that the sum of the number of scanning line pads G and the number of data line pads D in each repeated unit PU is 75.

In Embodiment 3, in order to cause the scanning line pads G and the data line pads D to be more evenly dispersed, a number R of data line pads D between two adjacent scanning line pads G in an arrangement direction RD meets a rule of Equation 2.

In Embodiment 3, $R=2\times3\times1$ to $2\times3\times2$, which means that a number of data line pads D between two adjacent scanning line pads G is between 6 and 12.

Figure 9:
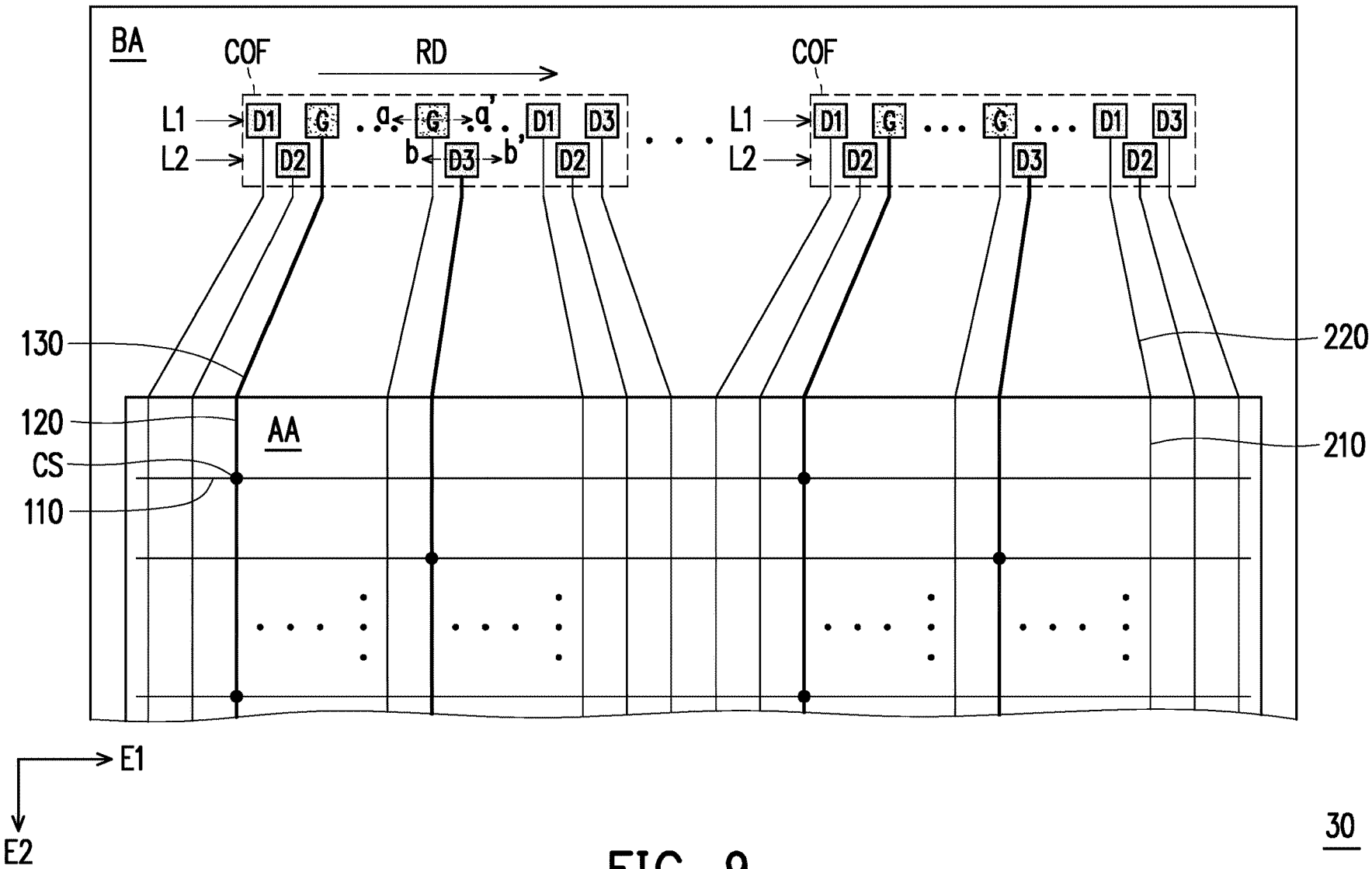
FIG. 9 is a schematic top view of a pixel array substrate according to an embodiment of the invention.
Figure 10A:
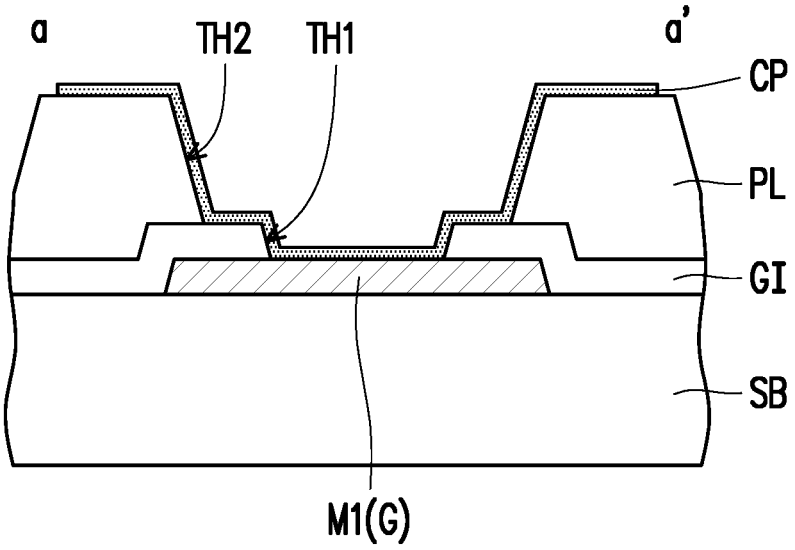
FIG. 10A is a schematic cross-sectional view taken along line aa' of FIG. 9.
Figure 10B:
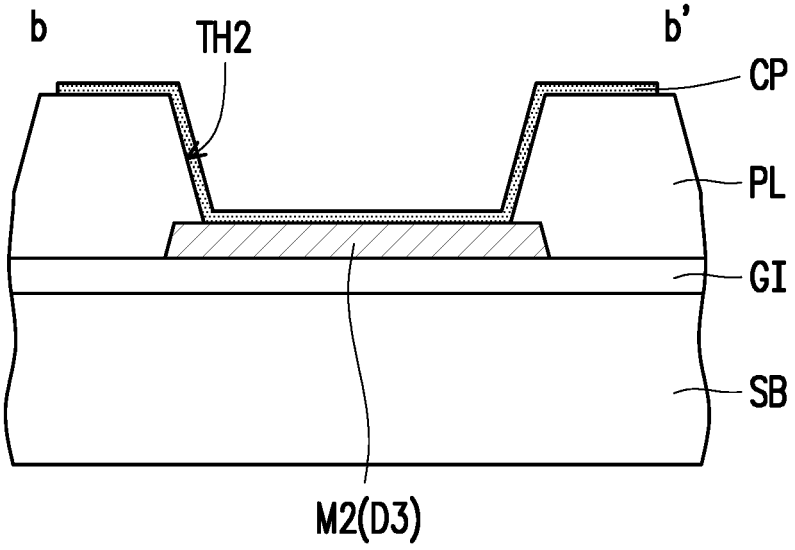
FIG. 10B is a schematic cross-sectional view taken along line bb' of FIG. 9.

FIG. 9 is a schematic top view of a pixel array substrate according to an embodiment of the invention. FIG. 10A is a schematic cross-sectional view taken along line aa' of FIG. 9. FIG. 10B is a schematic cross-sectional view taken along line bb' of FIG. 9. It must be noted herein that an embodiment of FIG. 9 uses element numbers and some content of the embodiment of FIG. 5, a same or similar reference numeral being used to represent a same or similar element, and description of same technical content is omitted. For the description of the omitted parts, reference may be made to the foregoing embodiments, and the descriptions thereof are omitted herein.

Referring to FIG. 9, in a pixel array substrate 30, scanning line pads G are located in a same row. For example, the scanning line pads G are all located in a first row L1, or the scanning line pads G are all located in a second row. In the present embodiment, pads (including the scanning line pads G and the data line pads D) in the first row L1 belong to a first metal layer M1, and pads (including the data line pads D) in the second row L2 belong to a second metal layer M2. In other embodiments, the pads in the second row L2 belong to the first metal layer M1, and the pads in the first row L1 belong to the second metal layer M2. In the present embodiment, all of the scanning line pads G are aligned with each other in an arrangement direction RD.

In the present embodiment, the scanning line pads G belong to the first metal layer M1, and therefore signal offset of different scanning lines 110 due to a switch structure (for example, a switch structure switching from the first metal layer M1 to the second metal layer M2) may be reduced.

The first metal layer M1 is located on a substrate SB. A gate insulating layer GI covers the first metal layer M1. The gate insulating layer GI on a pad (for example, a scanning line pad G) belonging to the first metal layer M1 has a through hole TH1. A flat layer PL is located on the gate insulating layer GI, and through holes TH2 are located on the pad (for example, the scanning line pad G) belonging to the first metal layer M1 and on a pad (such as a third data line pad D3) belonging to the second metal layer M2.

In some embodiments, a plurality of conductive structures CP are filled into the through holes TH1 and TH2 to be electrically connected to a corresponding scanning line pad G and the third data line pad D3, respectively. The conductive structure CP is made of, for example, a metal oxide.

Embodiment 4

In Embodiment 4, a pixel array substrate is driven in a manner of HG2D, and each sub-pixel overlaps two data lines and one scanning line. In Embodiment 4, each scanning line pad G is electrically connected to two corresponding scanning lines. In Embodiment 4, all of the scanning line pads G belong to a same metal layer (for example, the first metal layer or the second metal layer). In Example 4, a is 2, k is 4, and h is 1.

X:Y is 16:9. Each pixel PX includes 3 sub-pixels, that is, m is 3. The pixel array substrate has 3 scanning line signal chips, that is, n is 3.

In Embodiment 4, a sum of a number of scanning line pads G and a number of data line pads D in each repeated unit PU is calculated by Equation 1, $U=2\times(4\times3\times16+1\times3\times9)=438$, which means that the sum of the number of scanning line pads G and the number of data line pads D in each repeated unit PU is 438.

In Embodiment 4, in order to cause the scanning line pads G and the data line pads D to be more evenly dispersed, a number R of data line pads D between two adjacent scanning line pads G in an arrangement direction RD meets a rule of Equation 3.

$$R=2\times m\times N+1 \quad \text{Formula 3:}$$

In Equation 3, N is an integer between 1 and k+1.

In Embodiment 4, R=2×3×1+1 to 2×3×5+1, which means that a number of data line pads D between two adjacent scanning line pads G is between 7 and 31.

What is claimed is:

1. A pixel array substrate, comprising:

a plurality of scanning line pads and a plurality of data line pads located on a substrate, wherein the scanning line pads and the data line pads are arranged in an arrangement direction;

a plurality of scanning lines extending along a first direction;

a plurality of data lines and a plurality of gate transmission lines extending along a second direction, wherein the scanning lines are electrically connected to the scanning line pads through the gate transmission lines, and the data lines are electrically connected to the data line pads; and a plurality of red sub-pixels, a plurality of green sub-pixels, and a plurality of blue sub-pixels electrically connected to the scanning lines and the data lines, wherein the data line pads comprises a plurality of first data line pads, a plurality of second data line pads, and a plurality of third data line pads, wherein the red sub-pixels are electrically connected to the first data lines pads, the green sub-pixels are electrically connected to the second data line pads, and the blue sub-pixels are electrically connected to the third data line pads, wherein a number of the scanning line pads located between the first data line pads and the second data line pads or between the third data line pads and the second data line pads in the arrangement direction is less than a number of the scanning line pads located between the first data line pads and the third data line pads.

2. The pixel array substrate according to claim 1, wherein the red sub-pixels, the green sub-pixels, and the blue sub-pixels forming a plurality of pixels, a ratio of a number of rows of pixels arranged in the first direction to a number of rows of pixels arranged in the second direction is X:Y, wherein each of the pixels comprises m sub-pixels;

the scanning line pads and the data line pads are arranged into a plurality of smallest repeated units in the arrangement direction, and a sum of a number of the scanning line pads and a number of the data line pads in each of the smallest repeated units is U, wherein U=(4×m×X+n×Y), 2×(4×m×X+n×Y), (2×m×X+n×Y), or (m×X+n×Y), where n is a number of at least one scanning line signal chip electrically connected to the scanning line pads.

3. The pixel array substrate according to claim 2, wherein each of the red sub-pixels, the green sub-pixels, and the blue sub-pixels overlaps two corresponding data lines and one corresponding scanning line, and each of the scanning line pads is electrically connected to two corresponding scanning lines.

4. The pixel array substrate according to claim 2, wherein a part of the scanning line pads and a part of the data line pads belong to a first metal layer, and the other part of the scanning line pads and the other part of the data line pads belong to a second metal layer, wherein U=(4×m×X+n×Y).

5. The pixel array substrate according to claim 4, wherein there are R of the first data line pads, the second data line pads, and/or the third data line pads between two adjacent scanning line pads in the arrangement direction, and R=2×m×N, where N is 1, 2, 3, 4, or 5.

6. The pixel array substrate according to claim 2, wherein the scanning line pads all belong to a same metal layer, wherein U=2×(4×m×X+n×Y).

7. The pixel array substrate according to claim 6, wherein there are R of the first data line pads, the second data line pads, and/or the third data line pads between two adjacent scanning line pads in the arrangement direction, and R=2×m×N+1, where N is 1, 2, 3, 4, or 5.

8. The pixel array substrate according to claim 7, wherein the scanning line pads are aligned with each other in the arrangement direction.

9. The pixel array substrate according to claim 2, wherein each of the red sub-pixels, the green sub-pixels, and the blue sub-pixels overlaps two corresponding data lines and one corresponding scanning line, and different scanning lines are not electrically connected directly through the scanning line pads or the gate transmission lines, wherein U=(2×m×X+n×Y).

10. The pixel array substrate according to claim 2, wherein each of the red sub-pixels, the green sub-pixels, and the blue sub-pixels overlaps one corresponding data line and one corresponding scanning line, wherein U=(m×X+n×Y).

11. The pixel array substrate according to claim 1, further comprising:

a plurality of first fan-out lines electrically connecting the scanning line pads to the gate transmission lines; and a plurality of second fan-out lines electrically connecting the first data line pads, the second data line pads, and the third data line pads to the data lines, wherein the first fan-out lines and the second fan-out lines do not overlap each other.

12. The pixel array substrate according to claim 1, further comprises first common signal lines and second common signal lines, wherein the first common signal lines, the second common signal lines, and the scanning lines extend along the first direction, wherein the first common signal lines, the second common signal lines, and the scanning lines belong to a same conductor layer.

13. The pixel array substrate according to claim 12, further comprises third common signal lines, wherein the third common signal lines, the data lines, and the gate transmission lines extend along the second direction, and the third common signal lines, the data lines, and the gate transmission lines belong to a same conductor layer.

14. The pixel array substrate according to claim 1, wherein the scanning line pads and the data line pads are arranged into a plurality of smallest repeated units in the arrangement direction, and a sum of a number of the scanning line pads and a number of the data line pads in each of the smallest repeated units is more than 75.

15. The pixel array substrate according to claim 14, wherein the scanning line pads and the data line pads in one smallest repeating unit are arranged in an irregular order.

16. The pixel array substrate according to claim 14, wherein each smallest repeating unit has a same arrangement of the scanning line pads and the data line pads.

17. A pixel array substrate, comprising:

a plurality of scanning line pads and a plurality of data line pads located on a substrate;

a plurality of scanning lines extending along a first direction;

a plurality of data lines and a plurality of gate transmission lines extending along a second direction, wherein the data lines are electrically connected to the data line pads, and the scanning lines are electrically connected to the scanning line pads through the gate transmission lines;

a plurality of pixels located on the substrate;

at least one data line signal chip and at least one scanning line signal chip, the at least one data line signal chip being electrically connected to the data line pads, and the at least one scanning line signal chip being electrically connected to the scanning line pads, wherein the scanning line pads and the data line pads are arranged into a plurality of smallest repeated units in an arrangement direction, a sum of a number of the scanning line pads and a number of the data line pads in each of the smallest repeated units is more than 75.

18. The pixel array substrate according to claim 17, wherein a ratio of a number of rows of pixels arranged in the first direction to a number of rows of pixels arranged in the second direction is X:Y, wherein each of the pixels comprises m sub-pixels electrically connected to the scanning lines and the data lines, and wherein the sum of the number of the scanning line pads and the number of the data line pads in each of the smallest repeated units is U, wherein $U=a\times(k\times m\times X+h\times n\times Y)$, where n is a number of the at least one scanning line signal chip, and a, k, and h are positive integers.

19. The pixel array substrate according to claim 17, further comprises first common signal lines and second common signal lines, wherein the first common signal lines, the second common signal lines, and the scanning lines extend along the first direction, wherein the first common signal lines, the second common signal lines, and the scanning lines belong to a same conductor layer.

20. The pixel array substrate according to claim 19, further comprises third common signal lines, wherein the third common signal lines, the data lines, and the gate transmission lines extend along the second direction, and the third common signal lines, the data lines, and the gate transmission lines belong to a same conductor layer.

* * * * *